US005137211A

United States Patent [19]

Summer et al.

[11] Patent Number: 5,137,211

[45] Date of Patent: Aug. 11, 1992

[54] DISPENSING CARTON

[75] Inventors: Ken Summer, Teaneck; William Fitzgerald, Hillsdale, both of N.J.

[73] Assignee: Propper Manufacturing Co., Inc., Long Island City, N.Y.

[21] Appl. No.: 823,014

[22] Filed: Jan. 15, 1992

Related U.S. Application Data

[63] Continuation of Ser. No. 563,280, Aug. 6, 1990, abandoned.

[51] Int. Cl.[5] ..... B65D 5/16

[52] U.S. Cl. ..... 229/164; 206/45.18; 229/120.21; 229/122

[58] Field of Search ..... 229/120.21, 164, 122, 229/122.1; 206/45.18

[56] References Cited

U.S. PATENT DOCUMENTS

| | | | |
|---|---|---|---|
| 1,000,624 | 8/1911 | Pexton . | |
| 1,272,411 | 7/1918 | Fitz Gerald . | |
| 1,341,893 | 6/1920 | Fitz Gerald . | |
| 1,898,056 | 7/1930 | Johnson . | |
| 1,988,064 | 1/1935 | Weimann | 229/122.1 |
| 2,110,600 | 3/1938 | Holcolm . | |
| 2,556,707 | 6/1951 | Rendall et al. | 229/122.1 |
| 2,785,843 | 3/1957 | Shaw | 229/122.1 |
| 2,850,224 | 9/1958 | Meinhardt et al. | 229/120.21 |
| 3,536,247 | 10/1970 | Gadlel . | |
| 3,750,930 | 8/1973 | Roth . | |
| 3,993,241 | 11/1976 | Downing | 229/164 |
| 4,199,059 | 4/1980 | Maruszek | 206/45.18 |
| 4,944,452 | 7/1990 | Kent et al. | 229/120.21 |

*Primary Examiner*—Stephen P. Garbe
*Attorney, Agent, or Firm*—Amster, Rothstein & Ebenstein

[57] ABSTRACT

A carton for dispensing articles from the front thereof comprises a top wall, a bottom wall, and a laterally spaced apart pair of sidewalls connecting said top wall and said bottom wall. A shelf is disposed intermediate the top and bottom walls and extends substantially between the sidewalls, the shelf having a substantially horizontal front portion of appreciable length extending rearwardly from the front of the carton, and a rear portion of appreciable length inclined rearwardly and downwardly from the front portion.

21 Claims, 6 Drawing Sheets

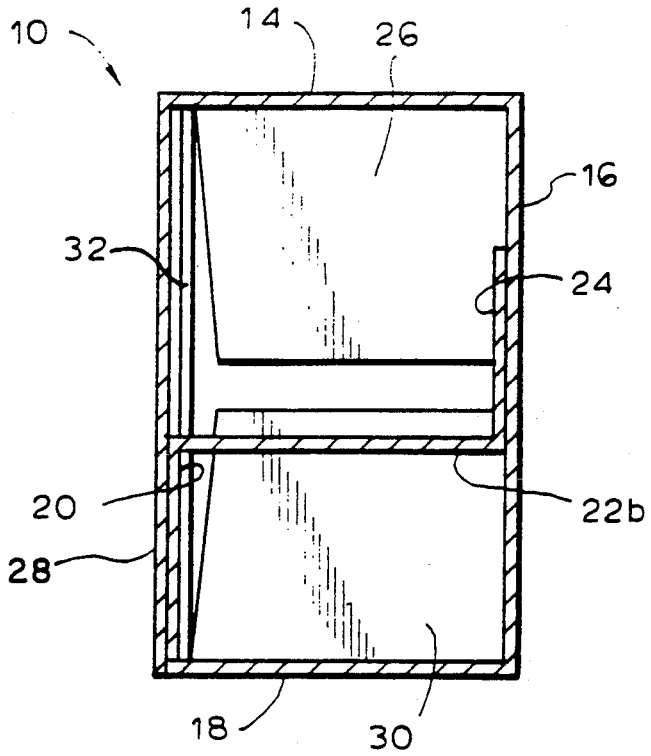
FIG. 6
FIG. 9
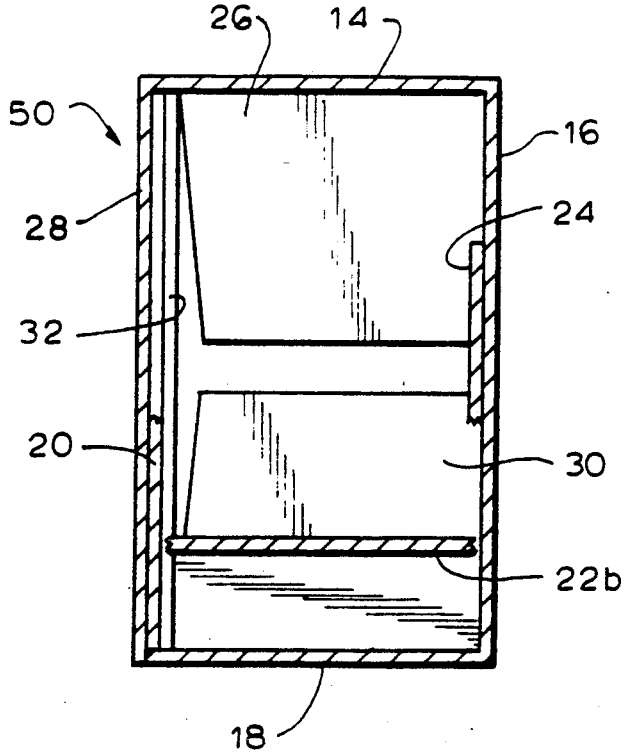

DISPENSING CARTON

This is a continuation of copending application Ser. No. 07/563,280 filed on Aug. 6, 1990, now abandoned.

BACKGROUND OF THE INVENTION

The present invention relates to dispensing cartons, and more particularly to cartons for dispensing articles, such as surgical blades, from the front thereof.

Cartons for dispensing articles from the front thereof are well known in the packaging art and are useful for dispensing a wide variety of different articles. Typically, the dispensing carton includes a top wall, a bottom wall, and a laterally spaced apart pair of sidewalls connecting the top wall and the bottom wall. A rear wall connects the sidewalls and the top and bottom walls at the rear. A front wall extends upwardly an appreciable distance from the bottom wall and connects the sidewalls at the front. Typically the dispensing carton is at least originally telescopically disposed within an outer carton, such as an ordinary end-opening carton or a carton with a tear-away front wall. The dispensing carton may be either left within the cuter carton or removed therefrom and used separately.

While the rear end of the dispensing carton is typically shut or closed by the rear wall, the front end is at least partially open so that the uppermost article of a stack of articles disposed therein can be easily slid out from the front of the dispensing carton. In some instances, the entire front of the dispensing carton is originally closed, like the rear end, but then opened—for example, by tearing along perforated lines—in order to reveal an at least partially open front end.

The dispensing carton frequently includes an upwardly and forwardly inclined plane in order to facilitate removal from the carton of the last few articles therein. In the absence of such a shelf, the articles disposed below the top level of the front wall tend to be difficult to remove. See, for example, U.S. Pat. Nos. 1,898,056; 2,785,843; and 3,750,930.

The known dispensing cartons have not proven to be entirely satisfactory. Some of these cartons are not formed simply by erecting the carton from a single blank, but require external pieces in addition to the blank. Other cartons require a rather complex assembly procedure in order to form the assembled carton, including the shelf. In either case, the cost of the carton may be substantially increased due to the extra material required and/or the extra assembly steps required. Indeed, it is not believed possible to manufacture a carton having an inclined shelf therein at the high speeds required for economical manufacture.

Accordingly, it is an object of the present invention to provide such a carton which can be easily and economically manufactured at high speeds.

A further object is to provide such a carton which is formed from a unitary, one-piece, integral blank, without requiring any inserts or the like (except for adhesive means).

It is also an object of the present invention to provide such a carton which is useful for dispensing surgical blades.

SUMMARY OF THE INVENTION

It has now been found that the above and related objects of the present invention are obtained in a carton for dispensing articles from the front thereof comprising a top wall, a bottom wall, and a laterally spaced apart pair of sidewalls connecting the top wall and the bottom wall. A shelf is disposed intermediate the top and bottom walls and extends substantially between the sidewalls. The shelf has a substantially horizontal front portion of appreciable length extending rearwardly from the front of the carton, and a rear portion of appreciable length inclined rearwardly and downwardly from the front portion.

In a preferred embodiment the carton additionally includes a front wall extending upwardly an appreciable distance from the bottom wall and connecting the sidewalls, the shelf extending rearwardly from the top of the front wall but not as far rearwardly as the back of the bottom wall. The shelf is of integral, one-piece, unitary construction with the front wall and has a front portion, which extends rearwardly an appreciable length parallel to the top wall and the bottom wall, and a rear portion, which is pivotable between a horizontal position and a rearwardly and downwardly inclined position (wherein it extends downwardly to the bottom wall). At least one divided tab portion is disposed on each side of the shelf rear portion and the adjacent inner side of one of the sidewalls.

Preferably the bottom wall is longer than the top wall, and the front of the sidewalls slope downwardly and forwardly from the front of the top wall to the front of the bottom wall.

The present invention also encompasses a blank for a dispensing carton having a shelf disposed intermediate the top and bottom walls and extending between the sidewalls. The blank comprises in a first series, a first sidewall panel, a top wall panel, a second sidewall panel, and a bottom wall panel, and, in a second series, a first securing flap panel, a shelf panel, and a second securing flap panel. A length of the shelf panel is detachably connected by tabs on respective sides to the first and second securing flap panels and another length of the shelf panel is fixedly connected on respective sides to the first and second securing flap panels. One of the securing flap panels of the second series is of unitary, one-piece, integral construction with one of the panels of the first series, and the first and second series together is of unitary, one-piece, integral construction.

In a preferred embodiment the blank additionally includes a front end panel disposed at one end of the shelf panel, a pair of front end flap panels disposed at one end of the pair of sidewall panels, a back end panel disposed at one end of one of the sidewall panels, and a pair of back end flap panels disposed at one end of the top and bottom wall panels. The top wall panel is shorter than the bottom wall panel and the sidewall panels extend at an angle from the top wall panel to the bottom wall panel adjacent the front of the blank. The top wall, the bottom wall, and the shelf panels are of substantially equal width, the first and second sidewall panels are of substantially equal width, and each of the first and second securing flap panels are of lesser width than the sidewall panels.

An unerected carton formed from the blank additionally includes adhesive means securing one of the securing flap panels to the inner surface of one of the sidewall panels and the other of the securing flap panels to the inner surface of the other of the sidewall panels. The first securing flap panel is of unitary, one-piece, integral construction with the bottom wall panel and is secured by the adhesive means to the first sidewall panel adjacent the bottom thereof, and the second securing flap panel is secured by the adhesive means to the second sidewall panel and is appreciably spaced from the bottom thereof.

The present invention further encompasses an intermediate carton in the production of a finished carton for dispensing articles from the front thereof. The intermediate carton comprises a top wall, a bottom wall, a laterally spaced apart pair of sidewalls connecting the top wall and the bottom wall, and a shelf disposed intermediate the top and bottom walls and extending substantially between the sidewalls. The shelf has a substantially horizontal front portion of appreciable length extending rearwardly from the front of the carton and a rear portion of appreciable length inclined rearwardly and downwardly from the front portion. The intermediate carton is characterized by the shelf rear portion being in substantially the same horizontal plane as the shelf front portion and being connected to the inner surface of the sidewalls by at least one tab on each side, the tabs being frangible by a downward pressure on the shelf rear Portion in order to incline the same rearwardly and downwardly.

BRIEF DESCRIPTION OF THE DRAWING

The above brief description, as well as further objects and features of the present invention, will be more fully understood by reference to the following detailed description of the presently preferred, albeit illustrative, embodiments of the present invention when taken in conjunction with the accompanying drawing wherein:

FIG. 6 is a sectional view thereof, taken along the line 6—6 of FIG. 5;

FIG. 9 is a sectional view thereof, taken along the line 9—9 of FIG. 8.

DETAILED DESCRIPTION OF THE PREFERRED EMBODIMENTS

Figure 1:
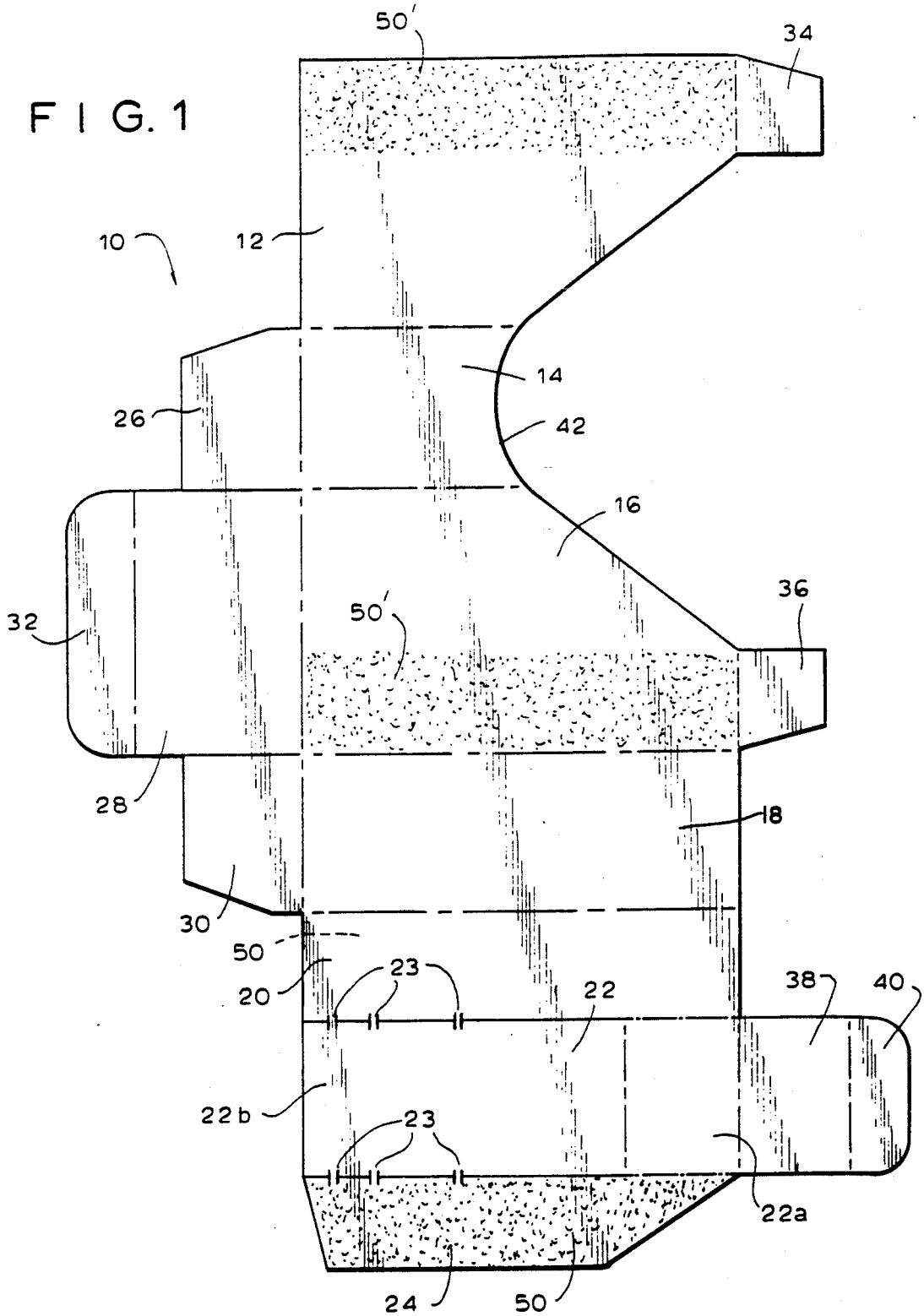
FIG. 1 is a top plan view of a blank according to the present invention.

Referring now to the drawing, and in particular to FIG. 1 thereof, therein illustrated is a blank according to the present invention, generally designated by the reference numeral 10. Proceeding from the top of FIG. 1 to the bottom thereof, the blank 10 includes a first side or sidewall panel 12, a top or top wall panel 14, a second side or sidewall panel 16, a bottom or bottom wall panel 18, a first glue or securing flap panel 20, a shelf panel 22, and a second glue or securing flap panel 24. Extending to the rear of the blank 10 (that is, to the left as shown in FIG. 1) and connected to the top panel 14, the second side panel 16 and the bottom panel 18 are a first back flap panel 26, a back panel 28 and a second back flap panel 30, respectively. The back panel 28 defines a foldline such that the free end thereof forms a foldable back lip 32 (which will later be inserted into the carton). Extending to the front of the blank 10 (that is, to the right as shown in FIG. 1) and connected to the first side panel 12, second side panel 16, and shelf panel 22 are a first front flap panel 34, a second front flap panel 36 and a front panel 38, respectively. The front panel 38 defines a foldline such that the free end 40 thereof defines a foldable front lip 40 (which will later be inserted into the carton). The top wall panel 14, the bottom wall panel 18, and the shelf panel 22 are of substantially equal width, the first and second sidewall panels 12, 16 are of substantially equal width, and each of the first and second glue panels 20, 24 are of lesser width than the sidewall panels 12, 16. The front surfaces (that is, to the right in FIG. 1) of the first side panel 12, top panel 14 and second side panel 16 define, intermediate the front flap panels 34, 36 a curve 42 of the type typically found in dispensing-carton blanks.

The phantom lines between the various panels of the blank represent foldlines, while the solid lines between the back flap panels 26, 30 and the back panel 28 are severance lines dividing these panels. The shelf 22 is divided into a front portion **22*a* and a rear portion 22*b*, the front and rear portions being divided by a foldline. The front portion 22*a* is of appreciable length, and the rear portion 22*b* is of appreciable length and typically of substantially greater length than the front portion 22*a*. While the front portion 22*a* is connected laterally to the first glue panel 20 and second glue panel 24 by foldlines, the rear portion 22*b* is connected to the same elements 20, 24 by foldlines which are also lines of potential severance or weakness. As illustrated, the shelf rear portion 22*b* is connected laterally only by a series of three frangible tabs 23** on each side thereof.

The blank 10 may be thought of composed of two series of panels, the first series comprising the panels 12, 14, 16 and 18 which form the basic outer parallelepiped, and a second series comprising the panels 20, 22, 24 which constitute the shelf panel 22 and the means for attaching the shelf panel 22 to the parallelepiped. In the second series, one length of the shelf panel 22 (namely, the shelf rear portion **22*b*) is detachably connected by tabs 23 on respective sides to the glue panels 20, 24 while another length of the shelf panel 22 (namely, the shelf front portion 22*a*) is fixedly connected on respective sides to the first and second glue panels 20, 24. Thus viewed, one of the glue panels 20, 24 of the second series is of unitary, one-piece, integral construction with one of the panels of the first series, the first and second series together being of unitary, one-piece, integral construction. Thus it will be appreciated that the blank 10** used in the formation of the carton of the present invention is of unitary, one-piece, integral construction.

Adhesive means 50 (indicated by stipling) may be placed on the first and second glue panels 20, 24, and more particularly on the surface of second glue panel 24, which is visible in FIG. 1 and on the surface of first glue panel 20 which is not visible in FIG. 1. Alternatively, or in addition thereto, adhesive means 50' may be disposed on the free end of the first side panel 12 aligned with front flap panel 34 (at the top of FIG. 1) and a central portion of the second side panel 16 above the level of front flap panel 36, both on the surface visible in FIG. 1.

Figure 2:
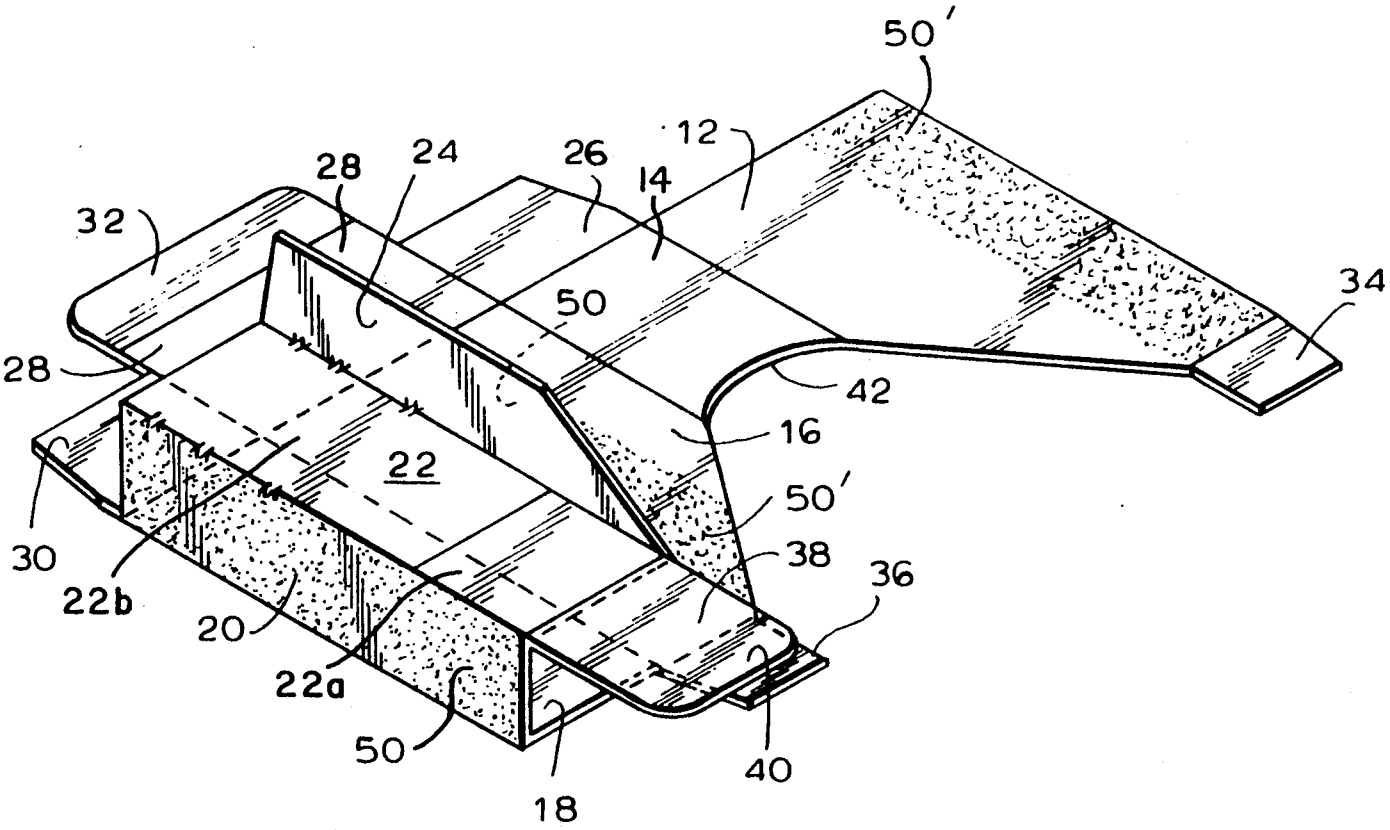
FIG. 2 is an isometric view of the blank in a partially erected configuration immediately prior to the first gluing thereof.
Figure 3:
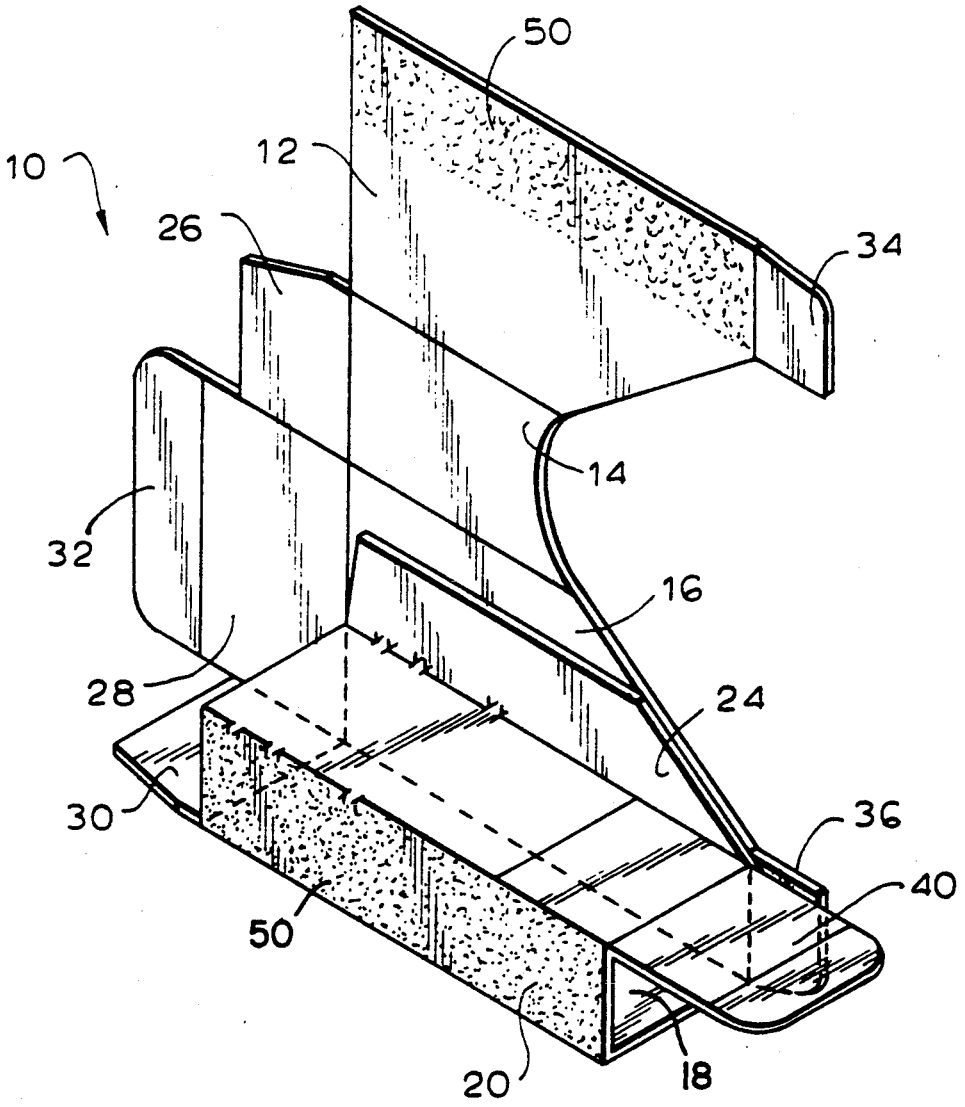
FIG. 3 is an isometric view of the carton immediately after the first gluing thereof.

Referring now to FIG. 2, the first glue panel 20 is folded upwardly relative to the bottom panel 18, the shelf panel 22 is folded at right angles thereto (so that it is horizontal and parallel to the bottom panel 18), and then the second glue panel 24 is folded upwardly (so that it extends above the horizontal shelf panel 22). Regardless of whether the adhesive means 50, 50' is disposed on the second side panel 16 or on the second glue panel 24, the two panels 16, 24 are brought into abutment and secured together by the adhesive means 50 and/or 50', as illustrated in FIG. 3, in a first gluing operation. As particularly shown in FIG. 3, the two side panels 12, 16 and the top panel 14 therebetween may be raised as a unit so as to bring the second side panel 16 and the second glue panel 24 into contact. Of course, alternatively the partially formed box including second glue panel 24, shelf panel 22, first glue panel 20 and bottom panel 18, may be elevated relative to the panels 16, 14, 12 with the same effect.

Figure 4:
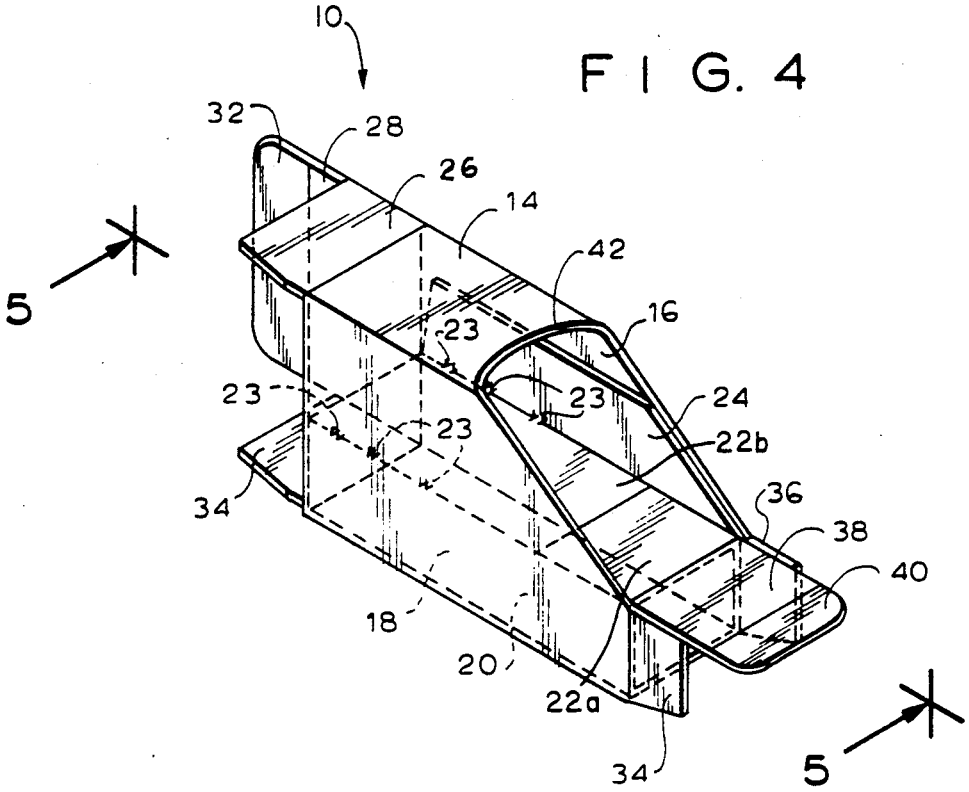
FIG. 4 is an isometric view of the carton after the second and final gluing thereof.

Referring now to FIG. 4, the first side panel 12 is folded over transverse to top panel 14, and top panel 14 is folded over transverse to first side panel 16, so that top panel 14 is horizontal and the free end of the first side panel 12 is in contact with and adhered to the first glue panel 20 in a second gluing operation, whether by adhesive means 50 on the first glue panel 20 or adhesive means 50 on the first side panel 12, or both. As there is nothing complex about the formation of the blank 10 as illustrated in FIGS. 4 and 5, the blank 10 may be formed using the conventional cutting, folding and gluing operations of conventional carton-forming apparatus operating at high speed.

Figure 5:
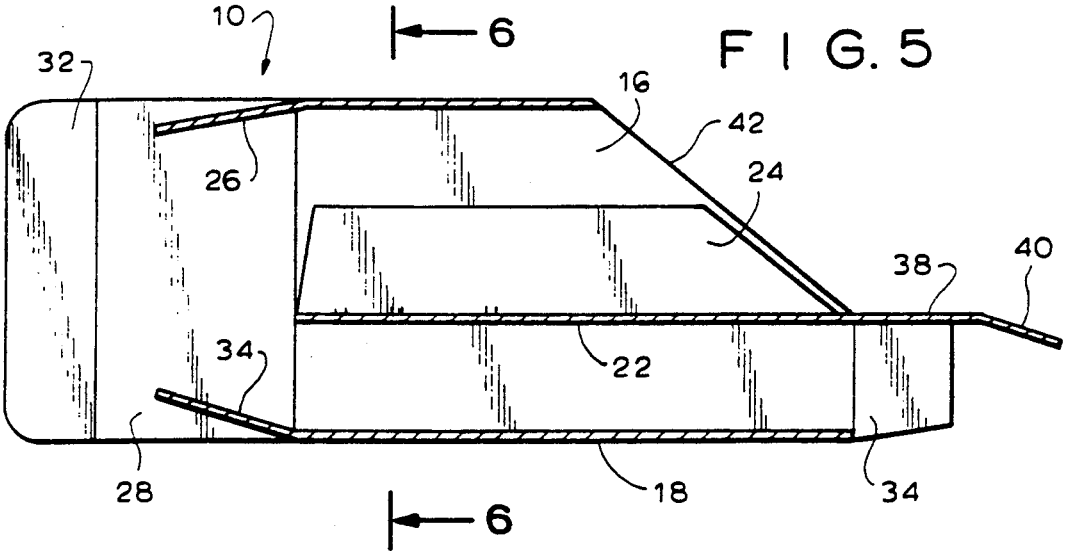
FIG. 5 is a sectional view thereof, taken along the line 5—5 of FIG. 4.

The blank 10, after the second gluing operation and as illustrated in FIGS. 4 and 5, can still be collapsed into a substantially flat configuration for storage and shipping. For example, the bottom panel 18 may be pushed upwardly so that one side of the flat structure would be formed by the bottom panel 18 and first side panel 12, or the top panel 14 may be pushed downwardly so that the same side of the flat structure would be formed by the top panel 14 and the first side panel 12. It will be appreciated indeed that, while FIGS. 1 through 5 illustrate the formation of the flat structure of the blank 10 with two glued portions as being formed by putting the blank 10 into an intermediate parallelepiped structure, the same final structure may be obtained in flat configuration without the blank ever having been put into a parallelepiped configuration. It is contemplated that the blank 10, with the two glued portions, will be stored and transported in the flat configuration until such time as it is ready for filling with the articles to be dispensed (e.g., surgical blades).

Figure 7:
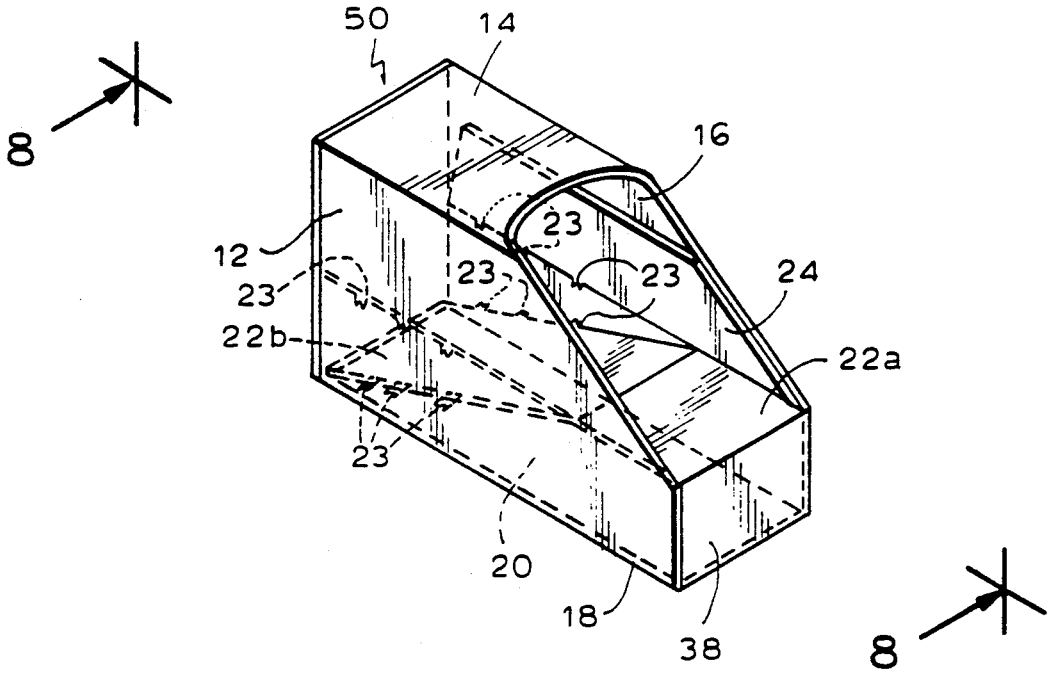
FIG. 7 is an isometric view of the erected carton.
Figure 8:
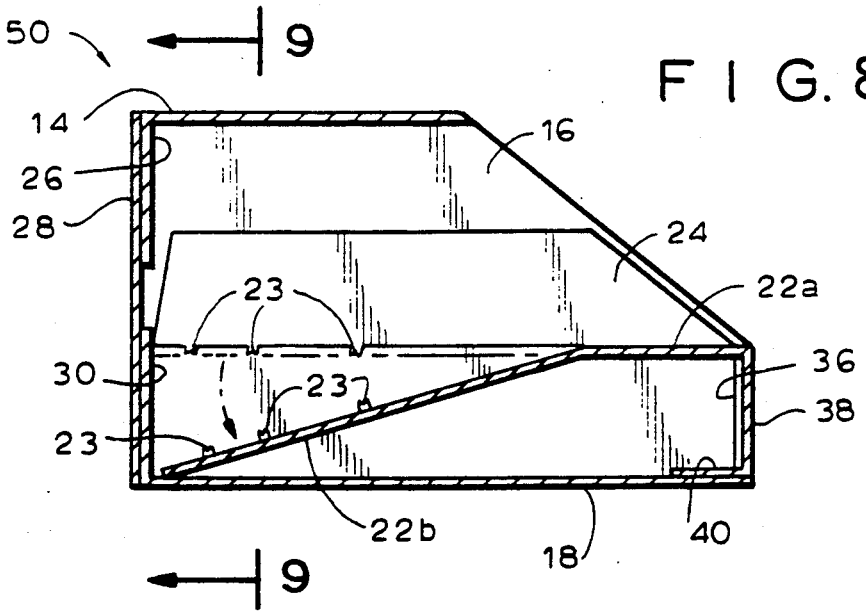
FIG. 8 is a sectional view thereof, taken along the line 8—8 of FIG. 7, with the original shelf position being illustrated in phantom line and the final shelf position being illustrated in solid line.

Referring now to FIGS. 7–9, in order to erect the carton for filling, the blank 10 is placed in a parallelepiped configuration by making the first and second sidewall panels 12, 16 parallel and the top and bottom wall panels 14, 18 parallel. Then the back flap panels 26, 30 are turned inwardly, and the back wall panel 28 folded downwardly thereover, with its free end or lip 32 being tucked into the carton abutting the first sidewall panel 12. Similarly, the front flap panels 34, 36 are turned inwardly, and the front wall panel 38 folded downwardly thereover, with its free end or lip 40 being tucked into the carton abutting the bottom panel 18.

It will be appreciated that at this intermediate point in the formation of the final erected carton 60 the front and rear portions **22*a*, 22*b* of shelf 22 are in planar disposition, forming a plane which is parallel to and intermediate the top wall 14 and bottom wall 18. At some point prior to insertion of the articles into the carton 60, the shelf rear portion 22*b* is depressed (as by a finger inserted through the front of the carton) with sufficient force to break the tabs 23 holding the shelf rear portion 22*b* laterally to the first and second glue panels 20, 24. The foldline intermediate the shelf front and rear portions 22*a*, 22*b* permits the shelf rear portion 22*b* to be pivoted between the original horizontal orientation illustrated in phantom line in FIG. 8 and the final rearwardly and downwardly inclined orientation illustrated in solid line in FIG. 8. Thus, in the fully-erected final carton 60, the shelf rear portion 22*b* is inclined rearwardly and downwardly from the front portion 22*a*, descending from the level of the top of the front wall 38 towards and typically contacting the bottom wall 18. After the tabs 23 have been broken, there are divided tab portions on each side of the shelf rear portion 22*b* and the inner side of the adjacent sidewall 12, 16 (the sidewalls 12, 16 including here the adhered-on glue panels 20, 24, respectively). The rear or free end of the shelf rear portion 22*b*, does not extend as far rearwardly as the back of the bottom wall 18 once the shelf rear portion 22*b* has been inclined. Due to the curve 42 affecting the front of the top 14 and sidewalls 12, 16, the bottom wall 18 is longer than the top wall 14 and the front of the sidewalls 12, 16 slope downwardly and forwardly from the front of the top wall 14 to the front of the bottom wall 18**.

Because the tabs 23 maintain the shelf rear portion **22*b* in the same plane as the shelf front portion 22*a* during construction of the carton from the blank 10, the carton making and forming apparatus may be operated at full speed rather than at the reduced speed which would be required if the shelf rear portion 22*b* were inclined or free floating so that it might be easily inclined thereafter. On the other hand, once the shelf rear portion 22*b* has been inclined, and the articles placed in the carton 60 for dispensing, even the last articles to be dispensed are oriented at a convenient and relatively safe position for grasping by the user as the shelf front portion 22*a* is horizontal and parallel to the top and bottom walls 14, 18. Thus, in the final carton 60, the shelf 22*b* is, in effect, bent with a rear portion 22*b* extending upwardly and forwardly into a front portion 22*a* extending horizontally and connecting the front of the shelf 22 to the top of the front wall 32 of the carton 60**.

It will be appreciated that tabs 23 play no role in maintaining the shelf rear portion **22*b* in its final position once it has been inclined, and function only to maintain the shelf rear portion 22*b* in its initial position prior to the intentional breaking of the tabs 23** in order to incline the same.

While the present invention is particularly directed to cartons useful for dispensing surgical blades, clearly the principles of the present invention are equally applicable to dispensing cartons for dispensing articles other than surgical blades.

In use, typically the blank 10 of the present invention is first erected to form an intermediate carton according to the present invention, and an intermediate carton of the present invention then has the rear shelf portion **22*b* thereof depressed in order to break the tabs 23 connecting it to the glue panels 20, 24 secured to sidewalls 12, 16 and incline the same, thereby to form the final carton 60 of the present invention. Typically the contents of the carton are inserted through the back wall of the carton prior to closure of the back by the back flaps 26, 30 and back wall 28**.

It will be appreciated that according to the present invention the shelf 22 of the fully erected, finished carton has a front portion 22*a* which is substantially horizontal and a rear portion 22*b* which extends rearwardly and downwardly (or the equivalent, forwardly and upwardly). This clearly distinguishes the shelf 22 according to the present invention from the shelves of the known prior art dispensing cartons which are typically planar and of a single given slope. This difference in structure between the shelf of the present invention and the prior art shelves is reflected in the use thereof. In the prior art dispensing cartons a downward pressure exerted on the front portion of the blade to be dispensed did not cause the blade to assume a horizontal orientation within the container; accordingly, the front tip of the blade remained pointed upwardly and thus presented a danger to the fingers of the user attempting to remove the blade from the dispensing carton. On the other hand, in dispensing cartons according to the present invention a downward pressure on the top of the forward portion of the blade to be dispensed causes that blade to assume a horizontal orientation (that is, to follow the horizontal disposition of the shelf front portion 22*a*) so that the front tip of the blade points laterally and, thus, is less likely to injure the fingers of the person attempting to remove the blade from the dispensing carton.

To summarize, the present invention provides a dispensing carton which presents even the last few articles therein in a satisfactory orientation for removal therefrom. The carton can be easily and economically manufactured at high speeds from a unitary, one-piece, integral blank, without requiring any inserts or the like (except for adhesive means). The carton is especially useful for dispensing surgical blades.

Now that the preferred embodiments of the present invention have been shown and described in detail, various modifications and improvements thereon will become readily apparent to those skilled in the art. Accordingly, the present invention is to be construed broadly and to be limited only by the appended claims, and not by the foregoing disclosure.

We claim:

1. A carton for dispensing articles through a front access opening thereof comprising:

(A) a top wall;

(B) a bottom wall;

(C) a laterally spaced apart pair of sidewalls connecting said top wall and said bottom wall; and (D) a shelf disposed intermediate said top and bottom walls and extending substantially between said sidewalls, said shelf having a substantially horizontal front portion of appreciable length extending rearwardly from the front of said carton and a rear portion of appreciable length inclined rearwardly and downwardly from said front portion; said top wall, sidewalls and shelf front portion together defining a front access opening for said carton through which the articles may be dispensed.

2. The carton of claim 1 additionally including a front wall extending upwardly an appreciable distance from said bottom wall and connecting said sidewalls, said shelf extending rearwardly from the top of said front wall.

3. The carton of claim 2 wherein said shelf is of integral, one-piece, unitary construction with said front wall.

4. The carton of claim 1 wherein said shelf does not extend as far rearwardly as the back of said bottom wall.

5. The carton of claim 1 wherein said shelf rear portion is pivotable between a horizontal position and a rearwardly and downwardly inclined position.

6. The carton of claim 1 wherein said shelf rear portion extends downwardly to said bottom wall.

7. The carton of claim 1 wherein said shelf front portion extends rearwardly an appreciable length parallel to said top wall and said bottom wall.

8. The carton of claim 1 including at least one divided tab portion on each side of said shelf rear portion and the adjacent inner side of one of said sidewalls.

9. The carton of claim 1 wherein said bottom wall is longer than said top wall, and the front of said sidewalls slope downwardly and forwardly from the front of said top wall to the top of said front wall.

10. A carton for dispensing articles through a front access opening thereof comprising:

(A) a top wall;

(B) a bottom wall;

(C) a laterally spaced apart pair of sidewalls connecting said top wall and said bottom wall, said bottom wall being longer than said top wall, and the front of said sidewalls sloping downwardly and forwardly from the front of said top wall to the top of said front wall;

(D) a front wall extending upwardly an appreciable distance from said bottom wall and connecting said sidewalls;

(E) a shelf disposed intermediate said top and bottom walls and extending substantially between said sidewalls, said shelf having a substantially horizontal front portion of appreciable length extending rearwardly from the top of the front wall of said carton and a rear portion of appreciable length inclined rearwardly and downwardly from said front portion but not extending as far rearwardly as the back of said bottom wall, said shelf being of integral, one-piece, unitary construction with said front wall, said shelf front portion extending rearwardly an appreciable length parallel to said top wall and said bottom wall, and said shelf rear portion being pivotable between a horizontal position and a rearwardly and downwardly inclined position wherein it extends downwardly to said bottom wall; said top wall, sidewalls and shelf front portion together defining a front access opening for said carton through which the articles may be dispensed; and (F) at least one divided tab portion being disposed on each side of said shelf rear portion and the adjacent inner side of one of said sidewalls.

11. A blank for a dispensing carton having a shelf disposed intermediate the top and bottom walls and extending between the sidewalls, comprising:

(A) in a first series, a first sidewall panel, a top wall panel, a second sidewall panel, and a bottom wall panel; and (B) in a second series, a first securing flap panel, a shelf panel, and a second securing flap panel, a length of said shelf panel being detachably connected by tabs on respective sides to said first and second securing flap panels and another length of said shelf panel being fixedly connected on respective sides to said first and second securing flap panels;

one of said securing flap panels of said second series being of unitary, one-piece, integral construction with one of said panels of said first series;

said first and second series together being of unitary, one-piece, integral construction.

12. The blank of claim 11 additionally including a front end panel disposed at one end of said shelf panel, a pair of front end flap panels disposed at one end of said pair of sidewall panels, a back end panel disposed at one end of one of said sidewall panels, and a pair of back end flap panels disposed at one end of said top and bottom wall panels.

13. The blank of claim 11 wherein said top wall panel is shorter than said bottom wall panel and the edges of said sidewall panels extend at an angle from said top wall panel towards opposite ends of the blank.

14. The blank of claim 11 wherein said top wall, said bottom wall, and said shelf panels are of substantially equal width, said first and second sidewall panels are of substantially equal width, and each of said first and second securing flap panels are of lesser width than said sidewall panels.

15. An unerected carton formed from a folded blank and adhesive means said blank being a blank for a dispensing carton having a shelf disposed intermediate the top and bottom walls and extending between the sidewalls, said blank comprising:

(A) in a first series, a first sidewall panel, a top wall panel, a second sidewall panel, and a bottom wall panel; and (B) in a second series, a first securing flap panel, a shelf panel, and a second securing flap panel, a length of said shelf panel being detachably connected by tabs on respective sides to said first and second securing flap panels and another length of said shelf panel being fixedly connected on respective sides to said first and second securing flap panels;

one of said securing flap panels of said second series being of unitary, one-piece, integral construction with one of said panels of said first series;

said first and second series together being of unitary, one-piece, integral construction; and said adhesive means securing one of said securing flap panels to a surface of one of said sidewall panels and the other of said securing flap panels to a surface of the other said sidewall panels.

16. The unerected carton of claim 15 wherein said first securing flap panel is of unitary, one-piece, integral construction with said bottom wall panel and is secured by said adhesive means to said first sidewall panel adjacent the bottom thereof, and said second securing flap panel is secured by said adhesive means to said second sidewall panel and is appreciably spaced from the bottom thereof.

17. A blank for a dispensing carton having a shelf disposed intermediate the top and bottom walls and extending between the sidewalls, comprising:

(A) in a first series, a first sidewall panel, a top wall panel, a second sidewall panel, and a bottom wall panel, said top wall panel being shorter than said bottom wall panel and the edges of said sidewall panels extending at an angle from said top wall panel towards opposite ends of the blank, said first series additionally including a front end panel disposed at one end of a shelf panel, a pair of front end flap panels disposed at one end of said pair of sidewall panels, a back end panel disposed at one end of one of said sidewall panels, and a pair of back end flap panels disposed at one end of said top and bottom wall panels; and (B) in a second series, a first securing flap panel, a shelf panel, and a second securing flap panel, said top wall, said bottom wall, and said shelf panels being of substantially equal width, said first and second sidewall panels being of substantially equal width, and each of said first and second securing flap panels being of lesser width than said sidewall panels, a length of said shelf panel being detachably connected by tabs on respective sides to said first and second securing flap panels and another length of said shelf panel being fixedly connected on respective sides to said first and second securing flap panels;

one of said securing flap panels of said second series being of unitary, one-piece, integral construction with one of said panels of said first series;

said first and second series together being of unitary, one-piece, integral construction.

18. An unerected carton formed from a folded blank and adhesive means said blank being a blank for a dispensing carton having a shelf disposed intermediate the top and bottom walls and extending between the sidewalls, said blank comprising:

(A) in a first series, a first sidewall panel, a top wall panel, a second sidewall panel, and a bottom wall panel, said top wall panel being shorter than said bottom wall and the edges of said sidewall panels extending at an angle from said top wall panel towards opposite ends of said blank, said first series additionally including a front end panel disposed at one end of a shelf panel, a pair of front end flap panels disposed at one end of said pair of sidewall panels, a back end panel disposed at one end of one of said sidewall panels, and a pair of back end flap panels disposed at one end of said top and bottom wall panels; and (B) in a second series, a first securing flap panel, a shelf panel, and a second securing flap panel, said top wall, said bottom wall, and said shelf panels being of substantially equal width, said first and second sidewall panels being of substantially equal width, and each of said first and second securing flap panels being of lesser width than said sidewall panels, a length of said shelf panel being detachably connected by tabs on respective sides to said first and second securing flap panels and another length of said shelf panel being fixedly connected on respective sides to said first and second securing flap panels;

one of said securing flap panels of said second series being of unitary, one-piece, integral construction with one of said panels of said first series;

said first and second series together being of unitary, one-piece, integral construction; and said adhesive means securing one of said securing flap panels to a surface of one of said sidewall panels and the other of said securing flap panels to a surface of the other of said sidewall panels, said first securing flap being of unitary, one-piece, integral construction with said bottom wall panel and secured by said adhesive means to said first sidewall panel adjacent the bottom thereof, and said second securing flap panel being secured by said adhesive means to said second sidewall panel and being appreciably spaced from the bottom thereof.

19. An intermediate carton in the production of a finished carton for dispensing articles from the front through a front access opening thereof, said intermediate carton comprising:

(A) a top wall;

(B) a bottom wall;

(C) a laterally spaced apart pair of sidewalls connecting said top wall and said bottom wall; and (D) a shelf disposed intermediate said top and bottom walls and extending substantially between said sidewalls, said shelf having a substantially horizontal front portion of appreciable length extending rearwardly from the front of said carton and a rear portion of appreciable length; in substantially the same horizontal plane as said shelf front portion and being connected to the inner surface of said sidewalls by at least one tab on each side, said tabs being frangible by a downward pressure on said shelf rear portion in order to incline the same rearwardly and downwardly; said top wall, sidewalls and shelf front portion together defining a front access opening for said carton through which the articles may be dispensed.

20. The unerected carton of claim 15 wherein said adhesive means secures said securing flap panels to the surfaces of said sidewall panels which will be disposed on the interior of the finished carton.

21. The unerected carton of claim 18 wherein said adhesive means secures said securing flap panels to the surfaces of said sidewall panels which will be disposed on the interior of the finished carton.

* * * * *